US008044870B2

(12) United States Patent
Okada et al.

(10) Patent No.: US 8,044,870 B2
(45) Date of Patent: Oct. 25, 2011

(54) ANTENNA APPARATUS

(75) Inventors: Hiroki Okada, Toyota (JP); Tetsuya Kobayashi, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 344 days.

(21) Appl. No.: 12/439,875

(22) PCT Filed: Aug. 31, 2007

(86) PCT No.: PCT/JP2007/067541

§ 371 (c)(1),
(2), (4) Date: Mar. 4, 2009

(87) PCT Pub. No.: WO2008/029928

PCT Pub. Date: Mar. 13, 2008

(65) Prior Publication Data

US 2010/0019978 A1 Jan. 28, 2010

(30) Foreign Application Priority Data

Sep. 4, 2006 (JP) ..... 2006-238964

(51) Int. Cl.
*H01Q 1/32* (2006.01)

(52) U.S. Cl. ..... 343/713; 343/711

(58) Field of Classification Search ..... 343/711, 343/712, 713

See application file for complete search history.

(56) References Cited

U.S. PATENT DOCUMENTS

| | | | | |
|---|---|---|---|---|
| 6,144,343 | A | 11/2000 | Furuya et al. | |
| 6,421,017 | B1 | 7/2002 | Inoue | |
| 6,496,138 | B1 | 12/2002 | Honma | |
| 6,788,255 | B2 * | 9/2004 | Sakamoto et al. | 343/700 MS |
| 7,113,136 | B2 * | 9/2006 | Marx | 343/703 |
| 7,289,074 | B2 * | 10/2007 | Yamaguchi | 343/713 |

FOREIGN PATENT DOCUMENTS

| | | |
|---|---|---|
| JP | 06-224614 | 8/1994 |
| JP | 10-290110 | 10/1998 |
| JP | 2001-297347 | 10/2001 |
| JP | 2003 240838 | 8/2003 |
| JP | 2003 273639 | 9/2003 |
| WO | 99 62137 | 12/1999 |

* cited by examiner

*Primary Examiner* — Tho G Phan

(74) *Attorney, Agent, or Firm* — Oblon, Spivak, McClelland, Maier & Neustadt, L.L.P.

(57) ABSTRACT

An antenna apparatus includes an antenna, and a resin material provided between the antenna and a reflector (windshield). The resin material includes portions, and the thickness (or dielectric constant) of each portion of the resin material is determined in accordance with a length of a straight line connecting a feeding point of the antenna, each portion of the resin material, and the reflector. Therefore, a phase of a reflected wave can be easily adjusted, thereby improving a performance of the antenna.

8 Claims, 6 Drawing Sheets

ANTENNA APPARATUS

TECHNICAL FIELD

The present invention relates to an antenna apparatus, and more particularly to an antenna apparatus mounted in a vehicle or the like.

BACKGROUND ART

Conventionally, a system such as an ETC, a VICS and a GPS has been widespread, and therefore an antenna used for such a system is commonly mounted in a vehicle. The antenna is typically mounted in or in the vicinity of an instrument panel provided in the front part of a vehicle interior, so as to favorably receive a radio wave from the outside of the vehicle.

On the other hand, well-known is an antenna apparatus which has a radome for enclosing an antenna thereof so as to, for example, protect the antenna (for example, Patent Document 1). The radome is typically made of synthetic resin material having a uniform thickness, or the like, and positioned so as to enclose the entire radiating surface of an antenna element.

Patent Document 1: Japanese Laid-Open Patent Publication No. 2003-273639

DISCLOSURE OF THE INVENTION

When an antenna is mounted in a vehicle, a reflected wave generated by an object near the antenna reflecting a radio wave transmitted from the antenna may deteriorate a performance of the antenna. For example, when an antenna is provided near an instrument panel of a vehicle, a reflected wave from a windshield or a wiper of the vehicle may adversely affect a performance of the antenna, depending on a frequency of a radio wave, a position at which the antenna is mounted, and the like. Specifically, when a direct wave from the antenna and the reflected wave are in opposite phase to each other, a gain performance of the antenna is deteriorated. Further, since a distance from a feeding point of the antenna to a reflector varies depending on directions in which the antenna radiates the radio wave, phases of the reflected waves from the respective directions are also different from each other. Therefore, gains of the antenna are different depending on the respective directions, and therefore a desired directivity may not be obtained, thereby deteriorating the performance of the antenna. Further, a conventional radome provided near an antenna has a uniform thickness, and therefore it is impossible to avoid variations in gain depending on the directions. That is, when a conventional radome is used as it is, it is impossible to improve a performance of an antenna.

Therefore, an object of the present invention is to provide an antenna apparatus capable of improving a performance of an antenna.

To achieve the above objects, the present invention has the following features. That is, a first aspect of the present invention is directed to an antenna apparatus comprising: a first antenna; and a resin material positioned between the first antenna and a reflector. The resin material has portions, and at least one of a thickness and a dielectric constant of the resin material is determined for each portion in accordance with a length of a straight line connecting a feeding point of the first antenna, a corresponding one of the portions of the resin material, and the reflector.

In a second aspect, at least one of the thickness and the dielectric constant of the resin material may be determined for each portion such that a phase difference between a direct wave from the first antenna and a corresponding reflected wave among reflected waves ranges between −90 degrees and 90 degrees, the reflected waves being obtained by reflecting, by the reflector, the direct wave having passed through the portions of the resin material.

In a third aspect, at least one of the thickness and the dielectric constant of the resin material may be determined for each portion such that a phase difference among the reflected waves obtained by reflecting, by the reflector, the direct wave which has been radiated from the feeding point and has passed through the portions of the resin material is smaller than a phase difference among the reflected waves obtained when each of the thickness and the dielectric constant is uniform in each portion of the resin material.

In a fourth aspect, courses each extend from the feeding point of the first antenna toward the reflector, and the thickness of the resin material may be determined such that the thickness of the resin material is greater on the course on which the length of the straight line connecting the feeding point of the first antenna and the reflector is relatively short than on the course on which the length of the straight line is relatively long.

In a fifth aspect, courses each extend from the feeding point of the first antenna toward the reflector, and the dielectric constant of the resin material may be determined such that the dielectric constant of the resin material is greater on the course on which the length of the straight line connecting the feeding point of the first antenna and the reflector is relatively short than on the course on which the length of the straight line is relatively long.

In a sixth aspect, a second antenna which is different from the first antenna, and a holder for holding the first antenna and the second antenna may be further provided.

In a seventh aspect, a second antenna which is different from the first antenna, and a holder for holding the first antenna and the second antenna may be further provided. In this case, at least one of the thickness and the dielectric constant of the resin material is determined for each portion in accordance with a length of a straight line connecting a feeding point of the second antenna, a corresponding one of the portions of the resin material, and the reflector.

In an eighth aspect, the resin material may correspond to an instrument panel of a vehicle. In this case, the antenna is provided in the instrument panel.

According to the first aspect, a phase of a reflected wave obtained by reflecting, by the reflector, a wave transmitted by the first antenna may be optionally adjusted by adjusting the resin material in accordance with the distance between the first antenna and the reflector. Therefore, adjustment of a gain performance of the first antenna prevents deterioration of a performance of the antenna.

According to the second aspect, an adjustment is performed such that the phase difference between the direct wave and the reflected wave ranges between −90 degrees and 90 degrees, and therefore reduction of a gain of the antenna due to the direct wave and the reflected wave being in opposite phase to each other is prevented.

According to the third aspect, it is possible to prevent a gain of the antenna from being changed depending on a radiating direction, that is, it is possible to prevent occurrence of variations in directivity of the antenna.

According to the fourth aspect, the thickness of the resin material varies so as to easily adjust a phase of the reflected wave. Further, the shorter the distance from the antenna to the reflector is, the greater the thickness of the resin material is, and therefore a phase difference among the reflected waves from the respective different directions can be reduced as compared to a case where the resin material has a uniform thickness.

According to the fifth aspect, when the dielectric constant of the resin material varies, it is possible to optionally determine the thickness of the resin material and adjust a phase of the reflected wave. Further, the shorter the distance from the antenna to the reflector is, the greater the dielectric constant of the resin material is, and therefore a phase difference among the reflected waves from the respective different directions can be reduced as compared to a case where the resin material has a uniform dielectric constant.

According to the sixth and the seventh aspects, the present invention is applicable to an integrated antenna including a plurality of antennas. That is, it is difficult for a conventional integrated antenna to allow all of a plurality of antennas to achieve satisfactory performances. However, according to the sixth aspect, an antenna performance is adjusted for each antenna, and therefore all of the plurality of antennas are allowed to achieve satisfactory performances.

According to the eighth aspect, the antenna is provided in an instrument panel, and therefore the resin material can serve as the instrument panel of the vehicle. When the resin material serves as an instrument panel of a vehicle, the features of the present invention can be realized without using a dedicated resin material.

DESCRIPTION OF REFERENCE NUMERALS

1, 11 antenna
2 resin material (instrument panel)
3 windshield
5 instrument panel
6, 8, 12, 15 resin material (radome)

BEST MODE FOR CARRYING OUT THE INVENTION

First Embodiment

Figure 1:
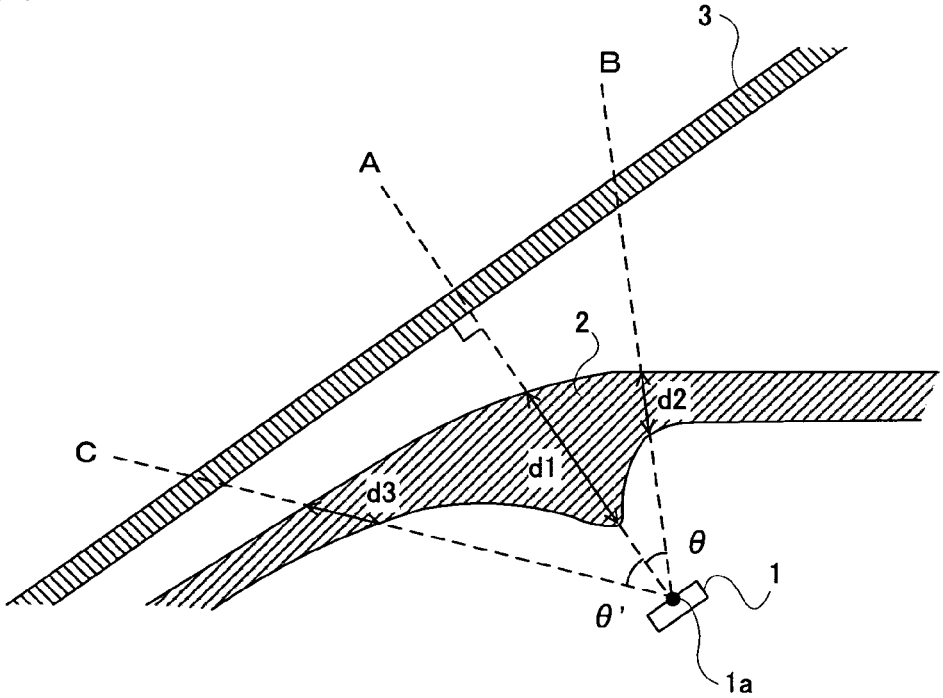
FIG. 1 is a diagram illustrating a structure of an antenna apparatus according to a first embodiment.

Hereinafter, with reference to FIGS. 1 and 2, an antenna apparatus according to a first embodiment of the present invention will be described. FIG. 1 is a diagram illustrating a structure of the antenna apparatus according to the first embodiment. In the first embodiment, the antenna apparatus is mounted in a vehicle, and FIG. 1 is a cross-sectional view of the antenna apparatus as viewed from a side of the vehicle.

In FIG. 1, the antenna apparatus comprises an antenna 1 and a resin material 2. The antenna apparatus is provided near a windshield 3 of a vehicle so as to orient a radiating surface of the antenna 1 toward the windshield 3. In the first to the fifth embodiments described below, on the assumption that the windshield 3 is a reflector, the structure of the antenna apparatus will be described. Specifically, the antenna apparatus reduces an influence of a reflected wave generated by the windshield 3 reflecting a radio wave transmitted from the antenna 1.

The antenna 1 is provided in an instrument panel corresponding to the resign material 2, that is, provided on the opposite side of an interior of the vehicle. In the present embodiment, the antenna 1 is an antenna, such as an ETC antenna, a VICS antenna, and a GPS antenna, for transmitting to and receiving from the outside of the vehicle a radio wave. Therefore, the antenna 1 is provided so as to orient its radiating surface forward and slightly upward with respect to the vehicle. In another embodiment, the antenna 1 may be any antenna, such as an in-vehicle wireless LAN antenna, mounted in a vehicle, in addition to an ETC antenna, a VICS antenna, and a GPS antenna. The antenna 1 may be provided at any position in a vehicle interior. Further, an antenna element may be of any structure. The antenna element may be structured as a flat-panel antenna such as a patch antenna, or the like.

The resin material 2 corresponds to the instrument panel (a substrate frame of the instrument panel) of the vehicle. That is, in the first embodiment, the resin material 2 serves as the instrument panel (the substrate frame thereof). The resin material 2 is provided between the antenna 1 and the windshield 3 corresponding to a reflector. The resin material 2 is made of ABS resin or the like. The resin material 2 preferably has a dielectric constant lower than an object corresponding to a reflector so as to reduce an influence of reflection on the resin material 2. For example, when the windshield 3 is made of glass having a relative dielectric constant of about 5 to 7, the resin material may have a relative dielectric constant of about 2.4 to 3. In the first embodiment, the instrument panel (the resin material 2) has a uniform dielectric constant.

As shown in FIG. 1, the resin material 2 includes portions, between the antenna 1 and the windshield 3, having varying thicknesses. Specifically, the thickness of a certain portion of the resin material 2 is determined in accordance with a length of a straight line connecting a feeding point 1*a* of the antenna 1, the certain portion of the resin material 2, and the windshield 3. More specifically, the thickness of each portion of the resin material 2 is determined such that a direct wave transmitted from the antenna 1 and a reflected wave from the windshield 3 are substantially in phase with each other, at the feeding point 1*a*. Hereinafter, with reference to FIG. 2, a method for determining the thickness of the resin material 2 will be described in detail.

Figure 2:
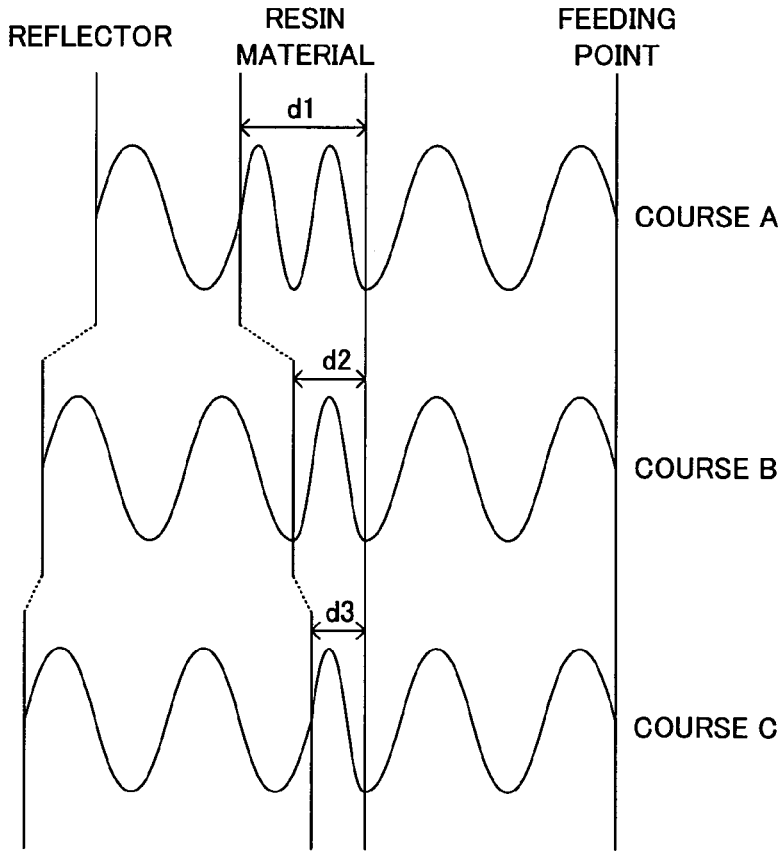
FIG. 2 is a diagram illustrating a method for determining a thickness of a resin material 2.

FIG. 2 is a diagram illustrating a method for determining the thickness of the resin material 2 and also illustrating waveforms of radio waves transmitted in three courses A, B, and C shown in FIG. 1. As shown in FIG. 1, the course A represents a straight line which passes through the feeding point 1*a* so as to be orthogonal to the windshield 3. That is, on the course A, the distance from the feeding point 1*a* to the windshield 3 is the shortest of the distances therebetween on all the courses. The course B extends, from the feeding point 1*a* toward the windshield 3, in the direction offset from the course A by angle θ. The course C extends, from the feeding point 1*a* toward the windshield 3, in the direction offset from the course A by angle θ' (>θ). Accordingly, distances from the feeding point 1*a* to the windshield 3 on the three courses A, B and C shown in FIG. 1 are increased in order, respectively (see FIG. 2). FIG. 2 shows that the length from the feeding point to the resin material is the same on each of the courses A, B, and C, so as to make easily understandable a difference in thickness among areas corresponding to the resin material 2 on the courses A, B, and C. However, as shown in FIG. 1, the length from the feeding point to the resin material may be different for each course in practice.

As shown in FIG. 2, a wavelength of a radio wave is shorter in the resin material 2 than in the air. Therefore, when the areas corresponding to the resin material 2, through which radio waves pass, have different lengths for each course from the feeding point 1*a* to the windshield 3 (that is, when the thickness of the resin material 2 varies for each course), it is possible to adjust the number of wavelengths between the feeding point 1*a* and the windshield 3. In other words, it is possible to adjust a phase of a direct wave obtained at a position of the windshield 3, and a phase of a reflected wave obtained at a position of the feeding point 1*a*.

As describe above, the thickness of each portion of the resin material 2 is determined such that the direct wave and the reflected wave are substantially in phase with each other at the feeding point 1*a*. For example, as shown in FIG. 2, the thickness of the resin material 2 on each of the courses A, B, and Cis determined such that the length from the feeding point 1*a* to the reflector (the windshield 3) corresponds to about 4.5 wavelengths. At this time, the round-trip length between the feeding point 1*a* and the windshield 3 corresponds to 9 wavelengths, and therefore the direct wave and the reflected wave are in phase with each other at the feeding point 1*a*. Thus, it is possible to adjust a phase difference between the direct wave and the reflected wave by adjusting the thickness of the resin material 2 for each course from the feeding point 1*a* to the windshield 3.

The distance from the feeding point to the windshield 3 is different for each course, and therefore the thickness of the resin material 2 varies for each course as shown in FIG. 2. Specifically, the thickness of each portion of the resin material 2 is determined such that the shorter the distance from the feeding point to the windshield 3 is, the greater the thickness of the resin material 2 is. In an example shown in FIGS. 1 and 2, when d1 represents the thickness of the resin material 2 on the course A, d2 represents the thickness of the resin material 2 on the course B, and d3 represents the thickness of the resin material 2 on the course C, the thickness of the resin material 2 is determined such that d1>d2>d3 is satisfied. In the above description, the thickness of the resin material 2 is determined for only the three courses A, B, and C. However, the reflected wave from the windshield 3 is returned to the feeding point 1*a* from directions, other than the directions represented by the courses A, B, and C, in which the antenna 1 radiates a radio wave, and therefore it is necessary to adjust the thicknesses of portions other than the portions on the courses A, B, and C. Each of the thicknesses of the other portions may be determined in accordance with a distance from the feeding point 1*a* to the windshield 3 in the same manner as that for determining the thicknesses d1 to d3.

The thickness of the resin material 2 may be determined such that the direct wave and the reflected wave are substantially in phase with each other. Therefore, the number of wavelengths between the windshield 3 and the feeding point 1*a* may be different for each course. For example, although in FIG. 2 the thickness of the resin material 2 is determined for each course A, B, and C such that the length from the feeding point 1*a* to the windshield 3 on each course A, B, and C corresponds to 4.5 wavelengths, the thicknesses of the resin material 2 may be determined for each course A, B, and C such that the length from the feeding point 1*a* to the windshield 3 on the at least one of the courses corresponds to, for example, 5.5 wavelengths.

Further, although in FIG. 2 the thickness of the resin material 2 is determined such that the direct wave and the reflected wave are in phase with each other, the thickness of the resin material 2 may be determined such that the reflected wave attenuates the direct wave by a predetermined attenuation amount or less (for example, about 1 to 3 dB). For example, the thickness of the resin material 2 may be determined such that a phase difference between the direct wave and the reflected wave ranges between −90 degrees and 90 degrees.

Further, the thickness of each portion of the resin material 2 is preferably determined such that a phase difference among reflected waves from portions of the windshield 3 is minimized at the feeding point 1*a*. When the phase difference among the respective reflected waves is reduced, the antenna 1 is allowed to obtain a constant gain throughout respective directions, and therefore it is possible to obtain a constant gain performance throughout the respective directions.

Further, FIG. 1 shows a cross section of a plane perpendicular to the transverse (left-right) direction of the vehicle. In this cross-sectional view, the thickness of the resin material 2 varies in accordance with the distance from the feeding point 1*a* to the windshield 3. However, in practice, the thickness of the resin material 2 varies in the transverse (left-right) direction of the vehicle in accordance with the distance from the feeding point 1*a* to the windshield 3.

When the resin material 2 has a structure as described above, the following effects are produced by the antenna apparatus. That is, when the thickness of the resin material 2 varies in accordance with the distance from the feeding point 1*a* of the antenna 1 to the reflector (the windshield 3), it is possible to adjust each of the reflected waves from different directions so as to be in phase with the direct wave from the antenna 1. Thus, it is possible to prevent the reflected wave from deteriorating a gain performance of the antenna 1. Further, when the thickness of the resin material 2 varies in accordance with the distance from the feeding point a of the antenna 1 to the reflector, it is possible to reduce the phase difference among the reflected waves from the respective different directions. Thus, the antenna is capable of achieving a uniform gain performance throughout the respective different directions.

Specifically, when the antenna 1 corresponding to an ETC antenna for transmitting and receiving a radio wave of 5.8 GHz is provided in the instrument panel, the windshield 3 is distanced from the antenna 1 by several tens of centimeters, that is, by the length corresponding to several wavelengths of the radio wave of about 5.8 GHz. At this time, a reflected wave from the wind shield 3 may adversely affect again of the antenna 1. However, in the first embodiment, the thickness of the resin material 2 is determined in accordance with the distance from the antenna 1 to the windshield 3, and therefore it is possible to prevent the reflected wave from deteriorating the performance of the antenna 1.

Second Embodiment

Next, with reference to FIG. 3, an antenna apparatus according to a second embodiment of the present invention will be described. In the first embodiment, the resin material for adjusting a phase of the reflected wave corresponds to a portion of an instrument panel of a vehicle. On the other hand, in the second embodiment, the resin material serves as a radome for enclosing an antenna. Hereinafter, the second embodiment will be described in detail, focusing on a difference from the first embodiment.

Figure 3:
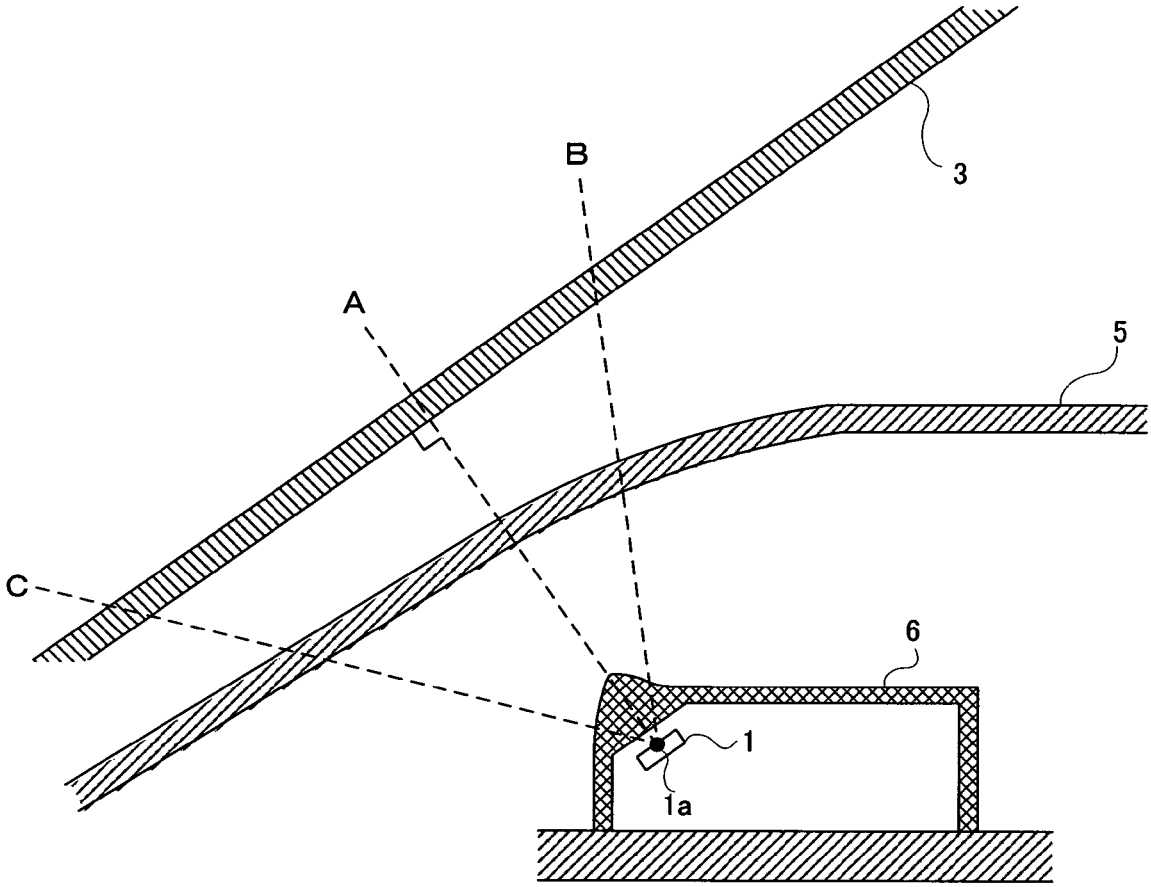
FIG. 3 is a diagram illustrating a structure of an antenna apparatus according to a second embodiment.

FIG. 3 is a diagram illustrating a structure of the antenna apparatus according to the second embodiment. As in the first embodiment, the antenna apparatus according to the second embodiment is mounted in a vehicle, and FIG. 3 is a cross-sectional view of the antenna apparatus as viewed from a side of the vehicle. In FIG. 3, the same components as shown in FIG. 1 are denoted by the same corresponding reference numerals as those used in FIG. 1, and a detailed description thereof is not given.

In FIG. 3, the antenna apparatus comprises the antenna 1 and a resin material 6. In the second embodiment, the resin material 6 serves as a radome. The radome holds and encloses the antenna 1. In the second embodiment, the radome (and the antenna 1 enclosed in the radome) is provided in an instrument panel 5 of the vehicle. In the second embodiment, the instrument panel 5 has a uniform thickness. The resin material 6 (the radome) may be made of the same material as that of the resin material 2 of the first embodiment.

As shown in FIG. 3, the resin material 6 includes portions, between the antenna 1 and the windshield 3, having varying thicknesses. Specifically, the thickness of a certain portion of the resin material 6 is determined in accordance with a length of a straight line connecting the feeding point 1*a* of the antenna 1, the certain portion, and the windshield 3. The method for determining the thickness of the resin material 6 is the same as that described for the first embodiment. That is, the thickness of each portion of the resin material 6 is determined such that a direct wave from the antenna 1 and a reflected wave from the windshield 3 are substantially in phase with each other, at the feeding point 1*a* (for example, such that a phase difference between the direct wave and the reflected wave ranges between −90 degrees and 90 degrees) (see FIG. 3).

In the second embodiment, the resin material 6 and the instrument panel 5 are provided between the feeding point 1*a* and the windshield 3. Therefore, in another embodiment, the thickness of the resin material 6 may be determined considering that a phase of the reflected wave from the windshield 3 may have been shifted due to the instrument panel 5 as well as the distance as described above, when the reflected wave arrives at the feeding point 1*a*. When the phase shift caused by the instrument panel 5 is small enough to be neglected, the thickness of the resin material 6 may be determined in accordance with only the distance as described above.

Further, in the second embodiment, a phase of the reflected wave is adjusted by adjusting the thickness of the radome. However, in another embodiment, the phase of the reflected wave may be adjusted by adjusting both the thickness of the radome and the thickness of the instrument panel 5. Specifically, in another embodiment, the antenna apparatus shown in FIG. 3 may be structured such that the thickness of the instrument panel 5 is determined in accordance with the distance between the antenna 1 and the windshield 3.

As described above, according to the second embodiment, as in the first embodiment, when the phase of the reflected wave is adjusted by adjusting the thickness of the resin material 6, it is possible to prevent the reflected wave from deteriorating a gain performance of the antenna 1, and to allow the antenna to achieve a uniform gain performance throughout the respective different directions. Further, according to the second embodiment, the resin material functioning as means for adjusting the phase of the reflected wave forms a portion of the radome, and therefore it is unnecessary to modify the instrument panel of the vehicle. Therefore, manufacture of a vehicle is facilitated as compared to manufacture of a vehicle in which the resin material serves as an instrument panel of the vehicle.

Third Embodiment

Next, with reference to FIGS. 4 to 7, an antenna apparatus according to a third embodiment of the present invention will be described. In the first and the second embodiments, the thickness of the resin material varies so as to adjust a phase of a reflected wave from a reflector. On the other hand, in the third embodiment, a dielectric constant of the resin material varies so as to adjust a phase of the reflected wave. Hereinafter, the third embodiment will be described in detail, focusing on a difference from the second embodiment.

Figure 4:
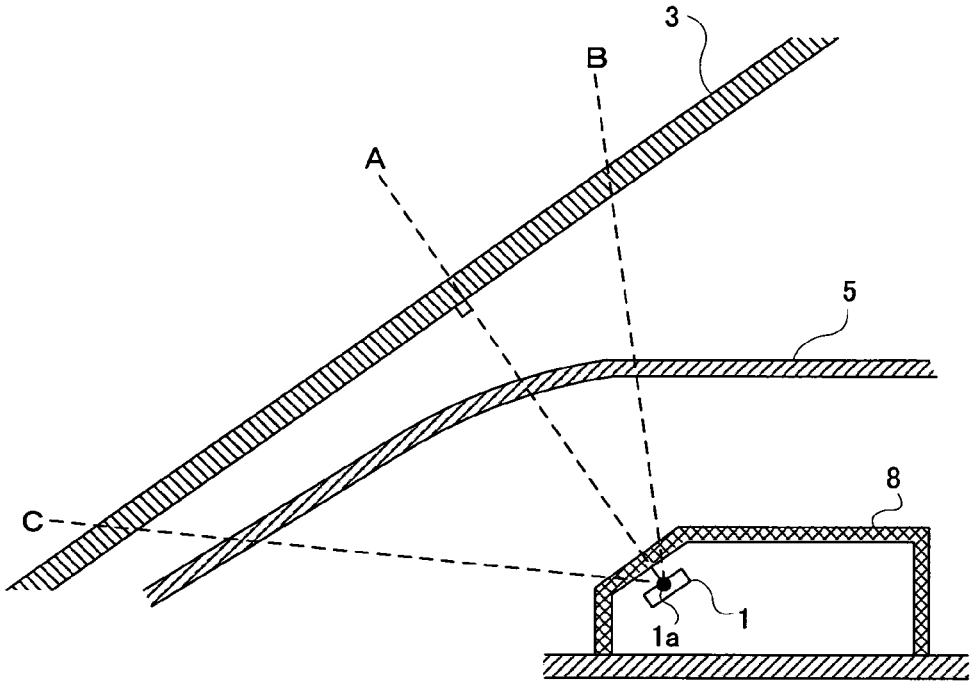
FIG. 4 is a diagram illustrating a structure of an antenna apparatus according to a third embodiment.

FIG. 4 is a diagram illustrating a structure of the antenna apparatus according to the third embodiment. As in the first embodiment, the antenna apparatus according to the third embodiment is mounted in a vehicle, and FIG. 4 is a cross-sectional view of the antenna apparatus as viewed from a side of the vehicle. In FIG. 4, the same components as shown in FIG. 3 are denoted by the same corresponding reference numerals as those used in FIG. 3, and a detailed description thereof is not given. The structure shown in FIG. 4 is the same as the structure shown in FIG. 3 except for a structure of the resin material.

In FIG. 4, the antenna apparatus comprises the antenna 1 and a resin material 8. In the third embodiment, the resin material 8 serves as a radome. The radome holds and encloses the antenna 1. In the third embodiment, the radome (and the antenna 1 enclosed in the radome) is provided in the instrument panel 5 of the vehicle. The resin material 8 (the radome) may be made of the same material as that of the resin material 2 of the first embodiment.

In the third embodiment, the resin material 8 includes portions having varying dielectric constants. Specifically, a dielectric constant of a certain portion of the resin material 8 is determined in accordance with a length of a straight line connecting the feeding point 1*a* of the antenna 1, the certain portion of the resin material 8, and the windshield 3. More specifically, the dielectric constant of each portion of the resin material 8 is determined such that a direct wave from the antenna 1 and a reflected wave from the windshield 3 are substantially in phase with each other, at the feeding point 1*a*. In the third embodiment, the resin material 8 has an almost uniform thickness. Hereinafter, with reference to FIGS. 5 to 7, a method for determining a dielectric constant of each portion of the resin material 8 will be described in detail.

Figure 5:
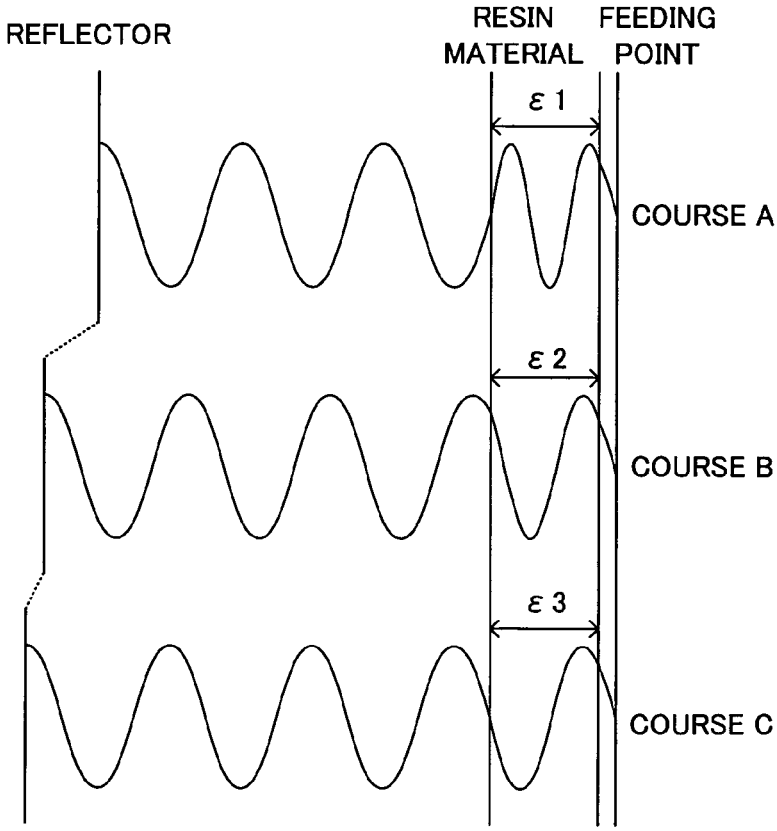
FIG. 5 is a diagram illustrating a method for determining dielectric constants of portions of a resin material 8.

FIG. 5 is a diagram illustrating a method for determining a dielectric constant of each portion of the resin material 8 and also illustrating waveforms of radio waves transmitted in three courses A, B, and C shown in FIG. 4. The courses A, B, and C shown in FIG. 4 correspond to the courses A, B, and C shown in FIG. 1, respectively, and distances from the feeding point 1*a* to the windshield 3 on the three courses A, B and C are increased in order, respectively. In FIG. 5, the thickness of the resin material is the same on each of the courses A, B, and C. However, in practice, since the respective courses A, B, and C extend from the antenna in the different directions from each other, the thickness of the resin material is not exactly the same on each of the courses A, B, and C. Further, although FIG. 5 shows that the length from the feeding point to the resin material is the same on each of the courses A, B, and C, the length from the feeding point to the resin material may be different for each of the courses A, B, and C in practice.

As shown in FIG. 5, a wavelength of a radio wave is shorter in the resin material 8 than in the air. Further, the wavelength of the radio wave in the resin material 8 varies in accordance with the dielectric constant of the resin material 8. Therefore, it is possible to adjust the number of wavelengths between the feeding point 1*a* and the windshield 3 by adjusting the dielectric constant of the resin material 8. That is, it is possible to adjust a phase of the direct wave obtained at a position of the windshield 3 and a phase of the reflected wave obtained at a position of the feeding point 1*a*.

As describe above, the dielectric constant of each portion of the resin material 8 is determined such that the direct wave and the reflected wave are substantially in phase with each other, at the feeding point 1*a* (for example, such that a phase difference between the direct wave and the reflected wave ranges between −90 degrees and 90 degrees). For example, as shown in FIG. 5, the dielectric constants $\in$1, $\in$2, to $\in$3 of the resin material 8 on the respective courses A, B, and C are determined such that the length from the feeding point 1*a* to the reflector (the windshield 3) corresponds to about 4.5 wavelengths. At this time, the round-trip length from the feeding point 1*a* to the windshield 3 corresponds to 9 wavelengths, and therefore the direct wave and the reflected wave are in phase with each other at the feeding point 1*a*. Thus, it is possible to adjust a phase difference between the direct wave and the reflected wave by adjusting the dielectric constant of the resin material 8 on each course from the feeding point 1*a* to the windshield 3, in a similar manner to that in which the phase difference is adjusted by adjusting the thickness of the resin material 8.

The distance from the feeding point to the windshield 3 is different for each course, and therefore the dielectric constant of the resin material 8 varies for each course as shown in FIG. 5. Specifically, the dielectric constant of each portion of the resin material 8 is determined such that the shorter the distance from the feeding point to the windshield 3 is, the larger the dielectric constant of the resin material 8 is. In an example shown in FIG. 5, when $\in$1 represents the dielectric constant of the resin material 8 in the course A, $\in$2 represents the dielectric constant of the resin material 8 in the course B, and $\in$3 represents the dielectric constant of the resin material 8 in the course C, the dielectric constant of the resin material 8 is determined such that $\in$1>$\in$2>$\in$3 is satisfied.

Figure 6:
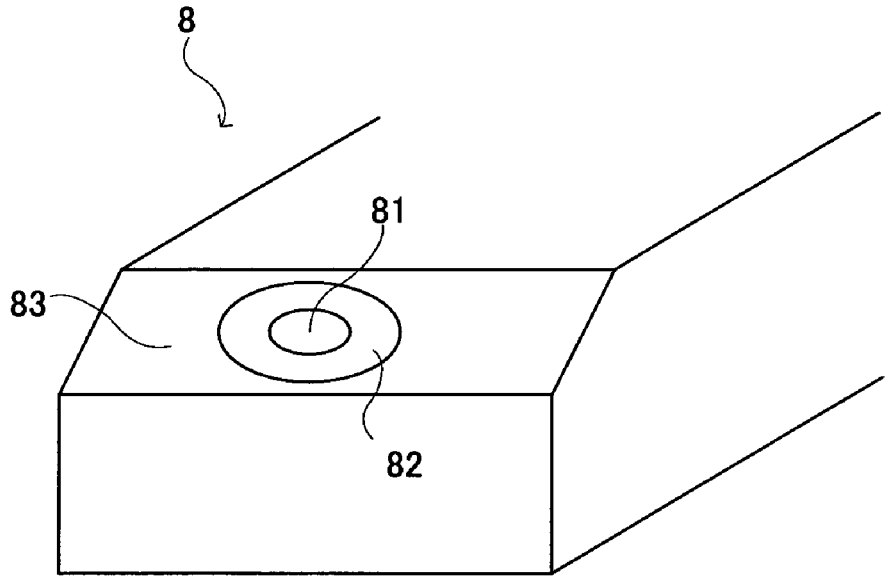
FIG. 6 is a perspective view illustrating a radome shown in FIG. 4.
Figure 7:
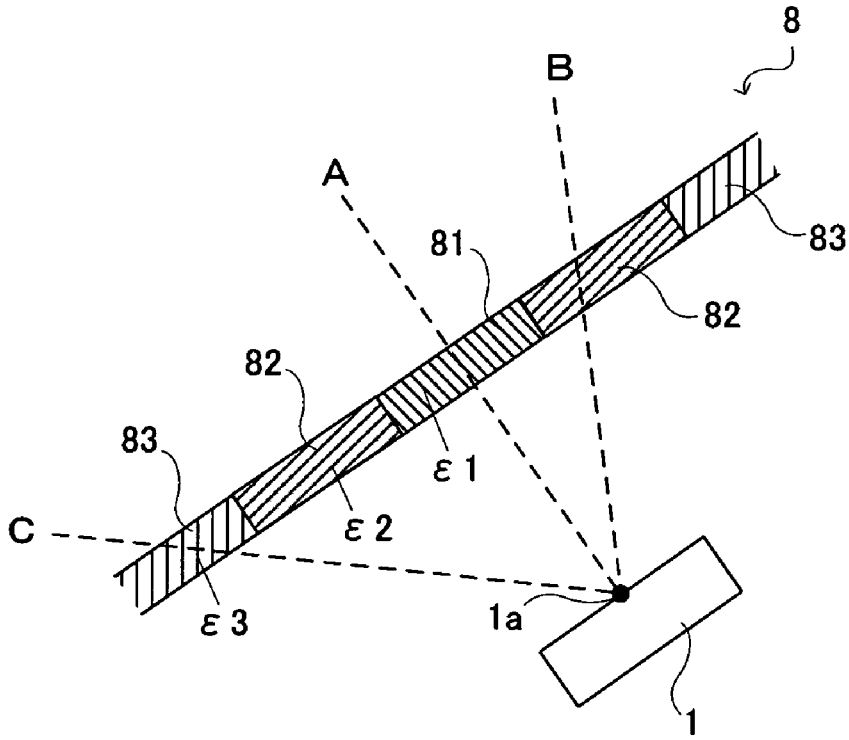
FIG. 7 is an enlarged view of the resin material 8 and the vicinity thereof shown in FIG. 4.

In the third embodiment, the resin material 8 is formed as shown in FIGS. 6 and 7 when the dielectric constant of the resin material 8 is determined in accordance with the distance described above. FIG. 6 is a perspective view of the radome shown in FIG. 4. FIG. 7 is an enlarged view of the resin material 8 and the vicinity thereof shown in FIG. 4. As shown in FIGS. 6 and 7, the resin material 8 includes three materials 81 to 83 having the dielectric constants different from each other. The dielectric constant of the first material 81 of a substantially circular shape has a value of $\in$1. The dielectric constant of the second material 82 of an annular shape has a value of $\in$2. The dielectric constant of the third material 83 has a value of $\in$3. Further, the first material 81 is positioned so as to allow the course A to pass through the first material 81. The second material 82 is positioned so as to surround the first material 81 and allow the course B to pass through the second material 82. The third material 83 is positioned so as to surround the second material 82 and allow the course C to pass through the third material 83. When the resin material 8 is formed as shown in FIGS. 6 and 7, the waveforms of radio waves transmitted in the respective courses A, B, and C are as shown in FIG. 5.

In the present embodiment, the resin material 8 includes the three materials 81 to 83 having the dielectric constants different from each other. However, in another embodiment, the resin material 8 may include at least two members having the dielectric constants different from each other. Thus, it is easy to fabricate the resin material which includes portions having the dielectric constants different from each other. Further, in the present embodiment, the dielectric constant of the resin material 8 varies for each portion in a stepwise manner. However, in another embodiment, the dielectric constant of the resin material 8 may vary for each portion in a continuous manner. Thus, the dielectric constant of each portion of the resin material may be determined with enhanced accuracy, and therefore it is possible to adjust a phase difference between the direct wave and the reflected wave with enhanced accuracy.

In the third embodiment, as in the first and the second embodiments, a phase difference among the respective reflected waves from portions of the windshield 3 is preferably minimized at the feeding point 1*a*. That is, in the third embodiment, the dielectric constants of the respective materials 81 to 83 are preferably determined such that the phase difference among the respective reflected waves is minimized.

As described above, according to the third embodiment, the dielectric constant of the resin material 8 varies, and therefore it is possible to adjust a phase of the reflected wave as in a case where the thickness of the resin material varies. Therefore, as in the first embodiment, it is possible to prevent the reflected wave from deteriorating a gain performance of the antenna 1, and to allow the antenna to achieve a uniform gain performance throughout the respective different directions. Further, in the third embodiment, the thickness of the radome (the resin material) may be determined in a more flexible manner than in the second embodiment, and therefore the resin material may have any outer shape. Therefore, in the third embodiment, the radome may have a shape nice to look at, and the size and the shape of the radome may be determined in a more flexible manner than in the second embodiment.

In the third embodiment, the resin material having the varied dielectric constant is used as a portion of the radome. However, in another embodiment, the resin material having the varied dielectric constant may be used as a portion of an instrument panel. That is, the resin material is used for the instrument panel of the vehicle, and the instrument panel may have a varied dielectric constant.

Fourth Embodiment

Next, with reference to FIG. 8, an antenna apparatus according to a fourth embodiment of the present invention will be described. The antenna apparatus according to each of the first to the third embodiments includes one antenna. On the other hand, the antenna apparatus according to the fourth embodiment is an integrated antenna apparatus including at least two antennas. Hereinafter, the fourth embodiment will be described in detail, focusing on a difference from the second embodiment.

Figure 8:
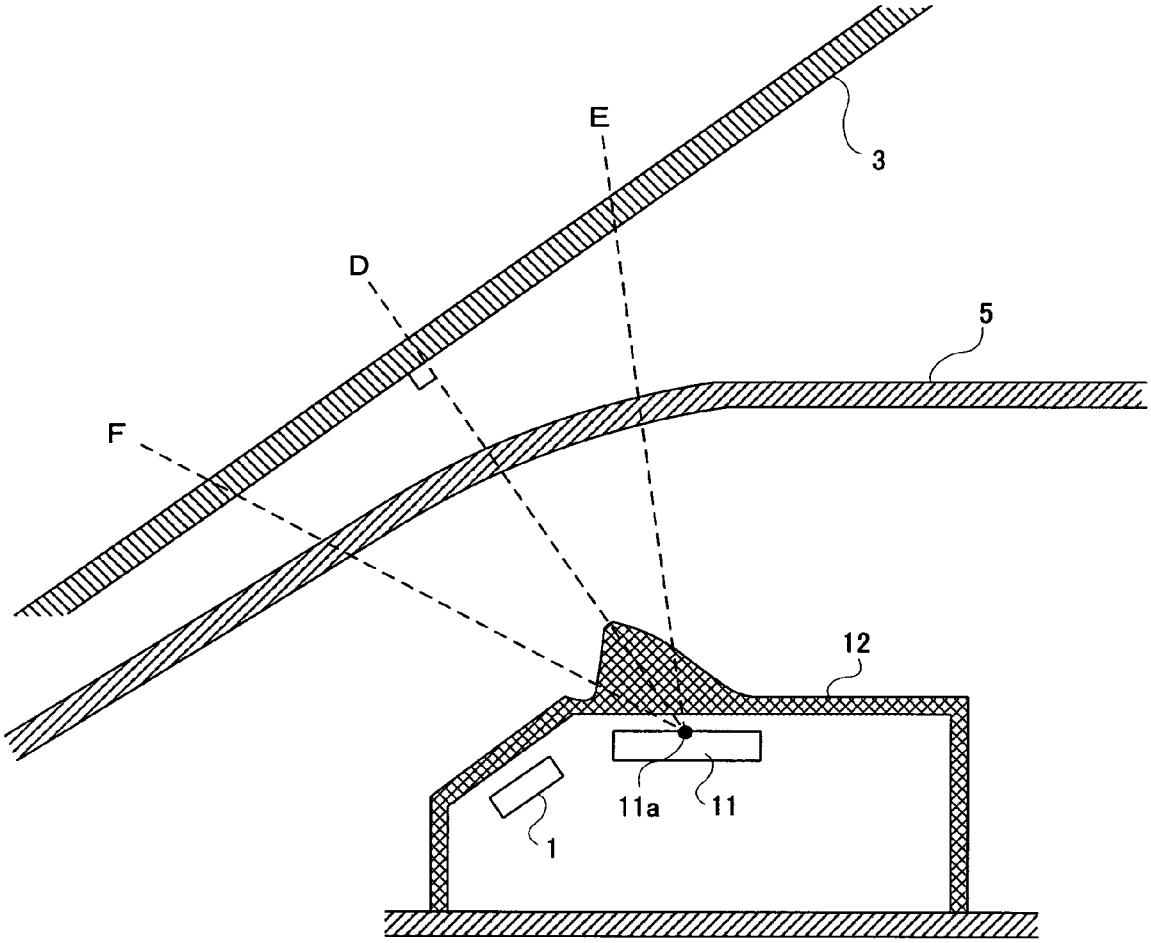
FIG. 8 is a diagram illustrating a structure of an antenna apparatus according to a fourth embodiment.

FIG. 8 is a diagram illustrating a structure of the antenna apparatus according to the fourth embodiment. As in the first embodiment, the antenna apparatus according to the fourth embodiment is mounted in a vehicle, and FIG. 8 is a cross-sectional view of the antenna apparatus as viewed from a side of the vehicle. In FIG. 8, the same components as shown in FIG. 3 are denoted by the same corresponding reference numerals as those used in FIG. 3, and a detailed description thereof is not given.

In FIG. 8, the antenna apparatus comprises a first antenna 1, a second antenna 11, and a resin material 12. The first antenna 1 is the same as the antenna 1 as shown in FIG. 1 and the like. In the fourth embodiment, the antenna 1 is referred to as the first antenna 1 so as to be distinguished from the second antenna 11. The second antenna 11 is an antenna, such as an ETC antenna, a VICS antenna, and a GPS antenna, for transmitting to and receiving from the outside of the vehicle a radio wave, as with the first antenna 1. A frequency of a radio wave transmitted and received by the second antenna 11 is different from a frequency of a radio wave transmitted and received by the first antenna 1. For example, the integrated antenna apparatus may be realized by using, as the first antenna 1, an ETC antenna for transmitting and receiving a radio wave in the frequency band of 5.8 GHz, and using, as the second antenna 11, a VICS antenna for transmitting and receiving a radio wave in the frequency band of 2.4 GHz.

In the fourth embodiment, the resin material 12 serves as a radome. The radome holds and encloses the antennas 1 and 11. The radome (and the antennas 1 and 11 enclosed in the radome) is provided in an instrument panel of the vehicle, as in the second embodiment. The resin material 12 (radome) may be made of the same material as that of the resin material 2 of the first embodiment. Further, in the fourth embodiment, the radome (the resin material 12) has a uniform dielectric constant.

As shown in FIG. 8, the radome includes portions, between the first antenna 1 and the windshield 3, having the same thickness. That is, in the fourth embodiment, the first antenna 1 requires no phase adjustment material for adjusting a phase of the reflected wave. In other words, in the fourth embodiment, the first antenna 1 is provided at such a position that the direct wave and the reflected wave are substantially in phase with each other when the thickness of the resin material does not vary (or when the dielectric constant thereof does not vary).

When an integrated antenna apparatus including a plurality of antennas is mounted in a vehicle, even if one antenna is allowed to be positioned so as to achieve a satisfactory antenna performance (that is, such that the direct wave and the reflected wave are substantially in phase with each other), it is substantially difficult to position the other antennas used for a frequency band other than a frequency band used for the one antenna such that each of the other antennas is also allowed to achieve a satisfactory antenna performance. For example, in an example shown in FIG. 8, a position at which the radome is provided so as to allow the first antenna 1 to achieve a satisfactory performance is not a position at which the second antenna 11 achieves a satisfactory performance. Also in this case, according to the present invention, the adjustment is performed for each of the plurality of antennas such that the direct wave and the reflected wave are allowed to be substantially in phase with each other.

Specifically, in the fourth embodiment, the radome includes portions, between the second antenna 11 and the windshield 3, having the thicknesses different from each other (see FIG. 8). As in the first and the second embodiments, the thickness of each portion of the radome is determined in accordance with the distance from the feeding point 11*a* of the second antenna 11 to the windshield 3. That is, the thickness of each portion of the resin material 12 is determined such that a direct wave from the second antenna 11 and a reflected wave from the windshield 3 are substantially in phase with each other, at the feeding point 11*a* (that is, the shorter the distance is, the greater the thickness is). In the fourth embodiment, as in the second embodiment, the thickness of the resin material 12 may be determined considering that a phase of the reflected wave from the windshield 3 may have been shifted due to the instrument panel 5 as well as the distance as described above, when the reflected wave arrives at the feeding point 11*a*.

As described above, according to the fourth embodiment, when a phase of the reflected wave is adjusted by adjusting the thickness of the resin material 12, it is possible to prevent the reflected wave from deteriorating a gain performance of the second antenna 11, and to allow the second antenna 11 to achieve a uniform gain performance throughout the respective different directions, as in the first embodiment. That is, the present invention is applicable to the integrated antenna apparatus including a plurality of antennas.

Fifth Embodiment

Next, with reference to FIG. 9, an antenna apparatus according to a fifth embodiment of the present invention will be described. The antenna apparatus of the fifth embodiment is an integrated antenna apparatus having at least two antennas, as with the fourth embodiment. In the fifth embodiment, a phase of the reflected wave is adjusted for each antenna by adjusting the thickness of the resin material. Hereinafter, the fifth embodiment will be described in detail, focusing on a difference from the fourth embodiment.

Figure 9:
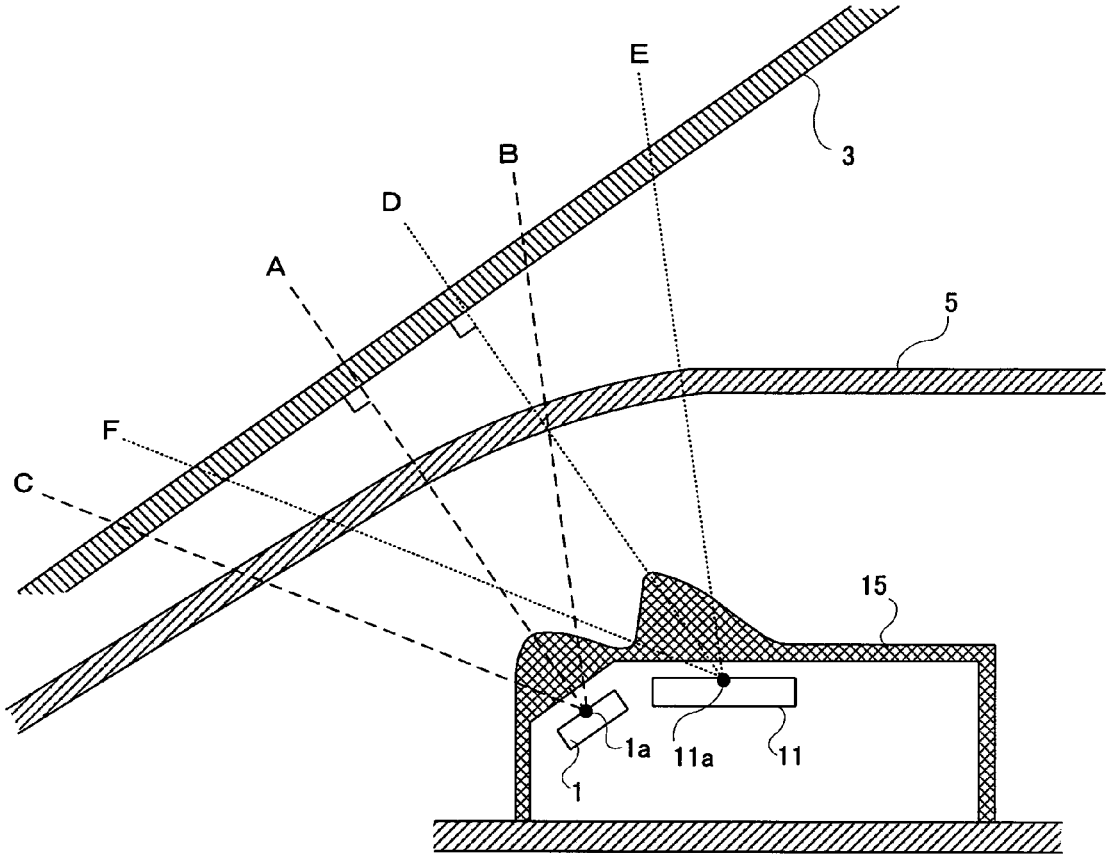
FIG. 9 is a diagram illustrating a structure of an antenna apparatus according to a fifth embodiment.

FIG. 9 is a diagram illustrating a structure of the antenna apparatus according to the fifth embodiment. As in the first embodiment, the antenna apparatus according to the fifth embodiment is mounted in a vehicle, and FIG. 9 is a cross-sectional view of the antenna apparatus as viewed from a side of the vehicle. In FIG. 9, the same components as shown in FIG. 8 are denoted by the same corresponding reference numerals as those used in FIG. 8, and a detailed description thereof is not given.

In FIG. 9, the antenna apparatus comprises the first antenna 1, the second antenna 11, and a resin material 15. The first antenna 1 and the second antenna 11 are the same as the first antenna 1 and the second antenna 11, respectively, as described in the fourth embodiment. However, in the fifth embodiment, the first antenna 1 and the second antenna 11 may transmit and receive waves in a common frequency band. That is, the first antenna 1 and the second antenna 11 may form a diversity antenna.

In the fifth embodiment, the resin material 15 serves as a radome as in the fourth embodiment. The radome (and the antennas 1 and 11 enclosed in the radome) is provided in an instrument panel of the vehicle, as in the fourth embodiment. The resin material 15 (radome) may be made of the same material as that of the resin material 2 of the first embodiment. Further, in the fifth embodiment, the radome (the resin material 15) has a uniform dielectric constant.

As shown in FIG. 9, the radome includes portions, between the second antenna 11 and the windshield 3, having the thicknesses different from each other, and the thickness of each portion of the radome is determined in accordance with the distance from the feeding point 11*a* to the windshield 3, as in the fourth embodiment. Further, in the fifth embodiment, the radome includes portions, between the first antenna 1 and the windshield 3, having the thicknesses different from each other, and the thickness of each portion of the radome is determined in accordance with the distance from the feeding point 1*a* of the first antenna 1 to the windshield 3, as in the second embodiment.

According to the fifth embodiment, when the antenna apparatus has the structure described above, a phase of the reflected wave is allowed to be adjusted for each of the first antenna 1 and the second antenna 11. Therefore, it is possible to prevent the reflected wave from deteriorating a gain performance of each of the first antenna 1 and the second antenna 11, and to allow each of the first antenna 1 and the second antenna 11 to achieve a uniform gain performance throughout the respective different directions. That is, adjustment can be performed so as to allow each antenna included in the integrated antenna apparatus to achieve a desired performance.

In the fourth and the fifth embodiments, a phase of the reflected wave is adjusted by adjusting the thickness of the resin material. However, as in the third embodiment, in the integrated antenna apparatus, a phase of the reflected wave may be adjusted by adjusting the dielectric constant of the resin material.

In the first, the second, the fourth, and the fifth embodiments, it is unnecessary to adjust the thicknesses of the entire portions of the instrument panel or the radome corresponding to the resin material such that the direct wave and the reflected wave are substantially in phase with each other. The thicknesses of only predetermined portions thereof may be adjusted. That is, only portions each located in a predetermined direction from the antenna may have their thickness adjusted in accordance with the distance between the antenna and the reflector. The predetermined direction represents a direction in which the antenna radiates a radio wave, and from which a gain of the antenna to be adjusted is obtained. For example, in an example shown in FIG. 1, the thickness of the instrument panel in the portions between the course B and the course C may be determined in accordance with the distance from the feeding point 1*a* to the windshield 3, and the other portions may have a uniform thickness. Further, in the third embodiment, it is unnecessary to adjust the dielectric constants of the entire portions of the radome corresponding to the resin material such that the direct wave and the reflected wave are substantially in phase with each other, and the dielectric constants of only predetermined portions thereof may be adjusted, as described for the thickness of the resin material.

INDUSTRIAL APPLICABILITY

As described above, the present invention is applicable to, for example, the antenna apparatus (integrated antenna apparatus) mounted in a vehicle.

The invention claimed is:

1. An antenna apparatus comprising:

a first antenna;

a reflector; and a resin material corresponding to an instrument panel positioned between the first antenna and the reflector, wherein the resin material has portions, and at least one of the thickness and the dielectric constant of the resin material is determined for each portion such that an absolute phase difference among the reflected waves obtained by reflecting, by the reflector, the direct wave which has been radiated from a feeding point of the antenna and has passed through the portions of the resin material is smaller than an absolute phase difference among the reflected waves obtained when each of the thickness and the dielectric constant is uniform in each portion of the resin material, and wherein the antenna is provided in the instrument panel.

2. The antenna apparatus according to claim 1, wherein at least one of the thickness and the dielectric constant of the resin material is determined for each portion such that a phase difference between a direct wave from the first antenna and a corresponding reflected wave among reflected waves ranges between −90 degrees and 90 degrees, the reflected waves being obtained by reflecting, by the reflector, the direct wave having passed through the portions of the resin material.

3. The antenna apparatus according to claim 1, wherein at least one of a thickness and a dielectric constant of the resin material is determined for each portion such that an absolute phase difference between a direct wave from the first antenna and a reflected wave obtained by reflecting the direct wave by the reflector is smaller than an absolute phase difference therebetween obtained when each of the thickness and the dielectric constant is uniform in each portion of the resin material.

4. The antenna apparatus according to claim 1, wherein courses each extend from the feeding point of the first antenna toward the reflector, and the thickness of the resin material is determined such that the thickness of the resin material is greater on the course on which the length of the straight line connecting the feeding point of the first antenna and the reflector is relatively short than on the course on which the length of the straight line is relatively long.

5. The antenna apparatus according to claim 1, wherein courses each extend from the feeding point of the first antenna toward the reflector, and the dielectric constant of the resin material is determined such that the dielectric constant of the resin material is greater on the course on which the length of the straight line connecting the feeding point of the first antenna and the reflector is relatively short than on the course on which the length of the straight line is relatively long.

6. The antenna apparatus according to claim 1, further comprising:

a second antenna which is different from the first antenna; and a holder for holding the first antenna and the second antenna.

7. An antenna apparatus comprising:

a first antenna;

a second antenna which is different from the first antenna;

a reflector;

a resin material positioned between the first antenna and the reflector, wherein the resin material has portions, and at least one of the thickness and the dielectric constant of the resin material is determined for each portion such that an absolute phase difference among the reflected waves obtained by reflecting, by the reflector, the direct wave which has been radiated from a feeding point of the antenna and has passed through the portions of the resin material is smaller than an absolute phase difference among the reflected waves obtained when each of the thickness and the dielectric constant is uniform in each portion of the resin material; and a holder for holding the first antenna and the second antenna, wherein at least one of the thickness and the dielectric constant of the resin material is determined for each portion in accordance with a length of a straight line connecting a feeding point of the second antenna, a corresponding one of the portions of the resin material, and the reflector.

8. An antenna apparatus comprising:

a first antenna;

a reflector;

a resin material positioned between the first antenna and the reflector, wherein the resin material has portions, and at least one of the thickness and the dielectric constant of the resin material is determined for each portion such that an absolute phase difference among the reflected waves obtained by reflecting, by the reflector, the direct wave which has been radiated from a feeding point of the antenna and has passed through the portions of the resin material is smaller than an absolute phase difference among the reflected waves obtained when each of the thickness and the dielectric constant is uniform in each portion of the resin material; and an instrument panel positioned between the resin material and the reflector.

* * * * *